United States Patent [19]

Davis

[11] 4,204,596

[45] May 27, 1980

[54] BOTTLE CARRIER

[75] Inventor: Frank E. Davis, Arlington, Tex.

[73] Assignee: Robert E. Smith, Denton, Tex.

[21] Appl. No.: 951,514

[22] Filed: Oct. 16, 1978

[51] Int. Cl.[2] ..... B65D 01/36; B65D 75/00

[52] U.S. Cl. ..... 206/203; 220/21; 206/139; 206/162

[58] Field of Search ..... D9/179; 206/139, 144, 206/162, 201, 203, 427, 506, 510; 220/21, 94 R, 94 A

[56] References Cited

U.S. PATENT DOCUMENTS

| | | | |
|---|---|---|---|
| 3,283,947 | 11/1966 | Cornelius | 206/203 |
| 3,297,196 | 1/1967 | Cornelius | 206/144 |
| 3,317,081 | 5/1967 | Cornelius | 206/144 |
| 3,363,802 | 1/1968 | Cornelius | 220/21 X |
| 3,376,998 | 4/1968 | Cornelius | 220/21 X |
| 3,587,915 | 6/1971 | Theobald et al. | 206/201 X |
| 3,991,879 | 11/1976 | Hirota | 206/203 |
| 4,040,517 | 8/1977 | Torokvei | 206/203 X |

FOREIGN PATENT DOCUMENTS

| | | | |
|---|---|---|---|
| 603438 | 12/1977 | Fed. Rep. of Germany | 220/21 |

*Primary Examiner*—Herbert F. Ross
*Attorney, Agent, or Firm*—Charles W. McHugh

[57] ABSTRACT

A one-piece, integrally molded plastic carrier adapted for supporting a plurality of bottles (such as beverage bottles) in a space envelope which is essentially the same as that space previously utilized by cardboard cartons. In an embodiment for carrying six bottles, a pair of non-planar handle supports extend upwardly from the base, with each of the supports resting in the central space between groupings of four bottles that are arranged to form a "square". The handle supports may be generally cylindrical or T-shaped, or a combination thereof; but in any case they are non-planar. The moment of inertia of the handle supports is high, so that the stiffness of the carrier is correspondingly high. A substantial slot is provided in the base between the two handle supports, and the slot is sized so that two bottle carriers may be nested together—with the handle of one carrier passing through the slot and into the bottom of another carrier. The structural elements of the carrier are appropriately sized and tapered (where necessary) in order to permit straight-pull injection molding.

26 Claims, 15 Drawing Figures

BOTTLE CARRIER

This invention relates generally to the field of carriers for a plurality of bottles, and more particularly it relates to a molded plastic carrier for bottles such as those commonly used in the soft-drink industry.

It is well known to replace bulky wooden carriers, expensive metal carriers, and sometimes hazardous cardboard carriers with molded plastic carriers for bottles. Representative of such molded plastic carriers are those shown in the Chelbor U.S. Pat. No. Re. 25,707 and the Torokvei U.S. Pat. No. 4,040,517. While the Chelbor design has several good features, it does suffer from at least one disadvantage in that one of two empty carriers must be inverted and nested in the other in order to transport such carriers without consuming an inordinate amount of space. That is, in order to avoid what amounts to a shipping penalty when moving empty carriers, the handle of one empty carrier must be inserted into an opening in the top of another empty carrier so that they are essentially "face-to-face". Then, when the empty carriers have arrived at a bottling plant, a substantial bit of hand labor is required to unload and reorient a truck full of such face-to-face carriers. In addition to the substantial amount of labor which is involved in handling carriers according to this particular Chelbor design, there is no provision for reliably interlocking two vertically arranged sets of empty carriers. In other words, the bases of two Chelbor carriers do not have any reliable recesses or protrusions which would preclude sideward movement of such bases with respect to each other. The lack of inherent stability of a stack of four or six empty carriers therefore requires additional straps or other restraining means in order to keep such a stack from falling over.

The Torokvei design which is disclosed in U.S. Pat. No. 4,040,517 solves at least some of the problems associated with a Chelbor carrier, in that each Torokvei carrier has a central recess in its bottom which is sized to accommodate the handle of another empty carrier. Therefore, a plurality of empty carriers can be stacked one upon another, with each carrier being arranged with a normal upright orientation. And, because of the interlocking between handles and recesses of sequential carriers, a stack of eight or ten such carriers can be essentially as stable as a stack of two. This improvement in bottle carriers has met with substantial commercial success, and many such carriers have been manufactured in recent years. Nevertheless, it is known that there is still room for improvement in bottle carriers; and, in particular, some of the problems that have developed with use of the Torokvei design have now prompted the creation of a greatly improved bottle carrier.

Before beginning with a description of the improved carrier of this invention, perhaps it would be appropriate to set out at least eight of the basic parameters that should be met by a bottle carrier if it is to enjoy widespread acceptance by those in the soft-drink industry.

The first parameter that is typically required by customers such as bottlers of Dr. Pepper, Coca Cola or Pepsi Cola, etc., is that there be full external walls or "billboards" upon which a bottler's advertising material may be presented. Thus, bottle carriers such as those described in U.S. Design Patent Nos. 202,665 and Design Patent 191,417 would not be favored by most modern bottlers. Secondly, a bottle carrier should ideally be manufactured as an integral unit, in order to eliminate any manufacturing labor in assemblying various parts. An integral carrier also eliminates the possibility of a handle or the like becoming lost while the carrier is on a retailer's shelf or a customer's cabinet. Thus, a carrier made in accordance with U.S. Pat. Nos. 3,232,476 to Cloyd or 3,223,280 to Kazimier would not be looked upon with favor by most manufacturers.

Thirdly, an optimized bottle carrier should be nestible when empty, in a manner similar to the aforementioned U.S. Pat. No. 4,040,517 to Torokvei. Additionally, at least some bottle carriers should have enough rigidity and overall strength as to be able to carry at least six liter-size bottles of a soft drink or other liquid such as milk. Six liter-size bottles of Coca Cola, for example, weight about 26 pounds, which is a substantial load to be carried by a plastic carrier—which, itself, ideally weighs as little as possible.

Another requirement for an ideal bottle carrier is that there should be no glass-to-glass contact between any of the bottles which are being carried. This requirement can be sometimes given less emphasis than other things, if webs and/or separating tabs are provided which permit only a negligible amount of contact while essentially precluding the harsh impact of one bottle against another. The object, of course, is to avoid bottle breakage during transport and the like.

A further requirement for a molded plastic carrier is that it have at least some bottom openings in order that wash water might be randomly sprayed onto the carriers without the risk of collecting in the bottom of the bottle pockets. While paper carriers seldom last for more than half-a-dozen round trips between a retailer and a consumer, molded plastic carriers have been known to last for years, even when they are subjected to a certain amount of abuse. And, as might be expected, after a plastic carrier has been used for as many as 100 round trips to the grocer and back, there sometimes arises a need to wash the carriers in order to render them more appealing as well as sanitary. Ideally, then, each pocket which is adapted to hold a bottle should have at least one substantial drain hole for passing wash water out of the bottom of the carrier.

Still another parameter which is of concern to a carrier producer is a satisfactory compromise between structural integrity of the carrier versus the quantity of plastic which is used in said carrier. That is, if the amount of plastic employed in a particular carrier should be of no concern, it is conceivable that a carrier could be built to last almost indefinitely. Such a carrier would likely be an economic failure in the marketplace, however, because the amount of utilized plastic would make it so much more expensive than competitive units as to render it unsalable to bottlers. Accordingly, an optimum carrier should definitely be strong; but its strength should come from efficient design and not merely from the bulk of material which is used.

Lastly—but by no means the least important of the eight basic parameters, an economically viable carrier *must* be compatible with the literally millions of dollars worth of equipment and supplies that are already in existence in the beverage industry. To this end, an optimum plastic carrier must have an external size so that it may be readily substituted for the thin paper carriers which fit in the millions of cases (both wooden and plastic) which are already in use. For six-bottle carriers of quart-size or liter-size bottles, the external walls of the carrier should be rectangular and approximately $7\frac{3}{4}$ by 11¼ inches. By fitting within such a space envelope, plastic carriers can even be employed right alongside paper carriers, and the bottling equipment (including automatic bottle loading and unloading machines) need never by adjusted or altered.

In addition to the basic eight parameters, an ideal bottle carrier is one that has a relatively broad handle which will not tend to cut off circulation in the hand of a person carrying full bottles. As mentioned above, six full liter-size bottles of a popular soft-drink weigh about 26 pounds. And many widely used paper carriers have only a load-bearing area of about 0.34 square inches which can be gripped by a person's projected fingers. Hence, with paper carriers, it is not unusual to experience loading in excess of 75 pounds per square inch on a person's fingers. Such loading can be uncomfortable at best, and could perhaps contribute to an accident if, for example, a child attempted to carry such a load and suddenly found the discomfort to be unbearable—to the extent that the carrier and bottles were simply dropped. One alternative that the consuming public has, of course, is to avoid purchasing six quarts or liters at one time, perhaps opting instead for an eight pack of 16-ounce bottles, making a total of 128 ounces of drink instead of 192. For a bottler who wishes to sell as many ounces of beverage as possible, the housewife who buys smaller bottles for comfort's sake constitutes a loss of potential sales. For this reason, then, it would be preferred that a six-bottle carrier have a handle which is wide enough to distribute the load over a substantial area of the fingers, making the chore of carrying full bottles more pleasurable.

Still another feature of an optimum molded plastic carrier is that it be adapted for molding with an injection molding die that is of simple construction. This is a goal of essentially all designers of molded plastic parts, but is sometimes sacrificed in favor of meeting other requirements, such as the eight basic parameters which were initially described above. If those eight parameters can be satisfied and the mold can also be relatively simple, then the bonus to the manufacturer is a savings of several thousands of dollars in initial mold construction, as well as additional savings during production of parts by virtue of a minimum amount of "down" time for maintenance and adjustments. To perhaps best illustrate this point, the six-bottle carrier which is currently being manufactured by Sceptor Manufacturing Co. under U.S. Pat. No. 4,040,517 to Torokvei is not exactly like the design shown in the patent—in that the handle of the commercial product has a relieved area which precludes what is commonly called a straight draw. To achieve the product which is being commercially marketed by Sceptor, a mold is employed which has at least two movable inserts or collapsible cores which must be pulled out of the way after a part has been molded, in order to provide clearance for expelling the carrier from the mold. (An exemplary mold having movable inserts is clearly shown in FIG. 17 of U.S. Pat. No. 3,289,252 to Bromley entitled "Machine for Molding Bottle Carrying Cases".) While injection molds with movable cores and the like are certainly within the level of skill of most mold fabricators, there is no question about the fact that molds designed with sliding parts are avoided if at all possible. In accordance with this invention, a bottle carrier is provided which meets the eight basic parameters which were first listed above, and also provides a bonus in that the mold can be of the straight-pull design. That is, the two halves of the mold which define the cavity into which plastic is injected do not have any undercut or relieved sections. After the molten plastic has been injected, the respective sections of the mold are simply pulled apart, and a molded carrier is ejected from the machine.

While it is a primary object of this invention to fill a long standing need for an improved bottle carrier, and to provide a carrier having exceptional strength-to-weight characteristics, etc., the many other objects and advantages of the several carriers disclosed herein will be more readily apparent from a thorough study of the specification and the claims appended thereto, as well as a review of the attached drawing in which:

In brief, the bottle carriers of the invention include a generally horizontal base upon which a plurality of bottles may be erectly positioned. The base will typically be generally rectangular, and will have a size such that it will fit into the space customarily occupied by a thin-wall cardboard carrier. Spaced supports extend upwardly from the base; and said supports are preferably tubular and generally cylindrical or conical. In an embodiment for holding six large soft drink bottles, i.e., 32-ounce or liter-size bottles, two tubular supports are provided, and they have a diameter immediately adjacent the base of about 1½ inches. The spaced supports extend upwardly from the base and terminate at two spaced regions thereabove. Extending between said two terminating regions is a handle having a comfortable length of at least 2½ inches and a width of at least ⅜ inch. The base has a central slot which is wide enough and long enough to accommodate the handle of an empty carrier which passes through the base slot and comes to rest interiorly of the tubular supports of the first carrier. Ideally, the wall thickness and protrusions of the respective elements of the carrier are such that a straight draw can be accomplished with an injection molding machine, in order that no collapsible walls or movable inserts are required in molding the carrier with a plastic material. Preferably, the handle has a concave shape, with the open part facing upwardly; with such a construction, the weight of six liter-size bottles of soft drink (about26 pounds) will not act to cut off circulation in a person's fingers when the bottles are carried.

Figure 1:
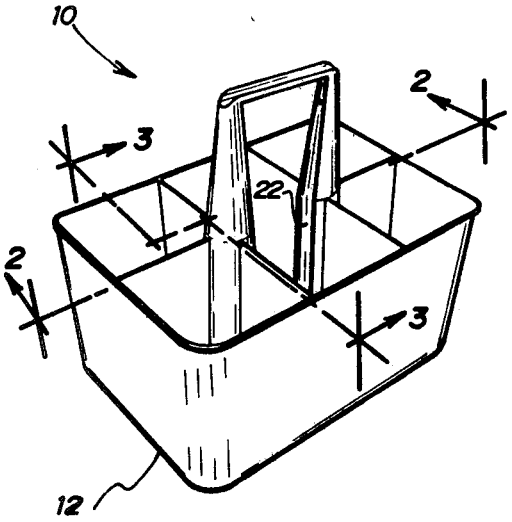
FIG. 1 is a perspective view of a six-bottle carrier having a size adapted to accommodate six liter-size bottles.
Figure 2:
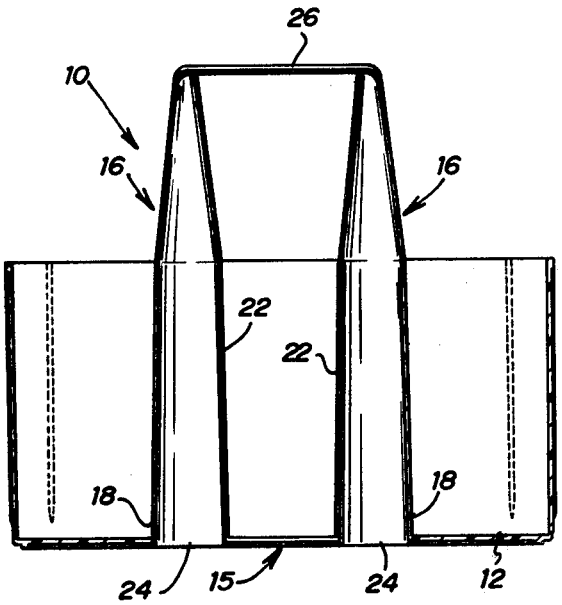
FIG. 2 is a cross-sectional elevational view of the bottle carrier taken in the plane represented by lines 2—2 in FIG. 1.
Figure 3:
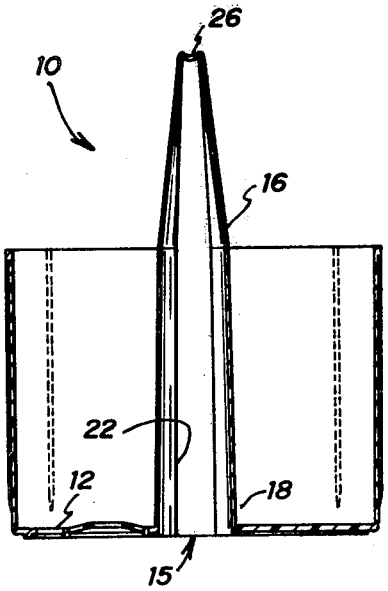
FIG. 3 is an elevational, cross-sectional view of the bottle carrier taken in the plane represented by numerals 3—3 in FIG. 1.

Referring initially to FIG. 1, a six-bottle carrier is shown which meets all of the basic eight parameters—and offers other advantages, as well. The carrier 10 has a base 12 which is adapted to rest generally horizontally when the carrier is positioned on a table or the like. The base 12 will typically be rectangular, and will include a receptor area for each of the six bottles, with the six receptor areas being arranged in two longitudinal rows of three areas each. As is customary with prior art cardboard carriers, the two rows are parallel and immediately adjacent each other. For quart-size or liter-size bottles, the rectangular base 12 will typically have a size of about 7¾×11¼ inches. The diameter of a liter-size Coke bottle is about 3.68 inches, and two such bottles placed side by side will consume about 7.36 inches; and, when the thickness of two plastic sidewalls is considered, it should be apparent that the 7¾ inch width of a six-bottle carrier does not have any significant wasted space. In a length direction, three liter-size Coke bottles consume over 11 inches, so there is essentially no wasted space in a length direction, either. The compactness of the carrier 10 is important because it is considered to be a commercial necessity that molded plastic carriers be compatible with the cases and machinery which are already in existence for handling thin-wall cardboard bottle cartons. In other words, the carrier disclosed herein can be distinguished over the bottle carrier shown in U.S. Pat. No. 3,297,196 to Cornelius in that the present carrier does not have the substantial space between adjacent rows of bottle receptor areas, which may best be seen in FIG. 3 of the Cornelius patent.

The base 12 may advantageously have a plurality of holes (one of which is shown as opening 14) which are useful in promoting drainage of water out of the pockets which are formed by the base and any peripheral or dividing cores. Additionally, placing apertures in the base 12 serves to reduce the quantity of plastic which is employed in forming the base; and, by carefully controlling the location for said holes, the overall strength of the base is not unduly diminished. This is because the loading which is typically placed on the base 12 by a bottle standing erectly thereon is not such as would create a hazardous situation in a perforated base. The base also has a central slot 15 which lies in a longitudinal plane which extends vertically between the two rows of bottle receptor areas. That is, the slot 15 lies on a line which generally divides the base 12 into two halves.

Figure 6:
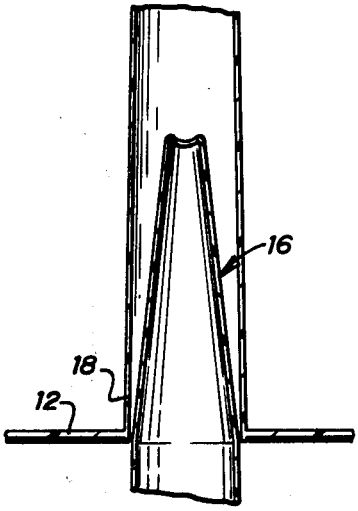
FIG. 6 is a fragmentary cross-sectional view of two nested carriers, with the upper portion of one tubular pillar extending upwardly into the lower portion of another tubular pillar on another carrier.

Extending upwardly from the base 12 are a pair of hollow pillars 16. In the preferred embodiment, these hollow pillars or tubular posts 16 are integrally molded with the base so as to be permanently attached thereto without the requirement for any assembly step. One of the hollow pillars 16 is adjacent one end of the slot 15, and the other pillar is adjacent the other end of the slot. The two pillars 16 are preferably cylindrical in the region immediately adjacent the base 12, and generally conical in the region 20 near the top of the pillars 16. (The reason for preferring cylindrical and conical sections for the hollow pillars 16 will be discussed in greater detail hereinafter.) Even though the lower region 18 of the hollow pillars is generally cylindrical, it preferably has at least a slight taper, e.g., one or two degrees, in order to foster the removal of a core which is utilized during the molding of a plastic carrier. Thus, the two outer sides of the pillars—namely, those two sides which are most remote from each other, are slightly inclined toward each other. The two interior sides of the pillars each have a vertical opening 22 which is symmetrically spaced with respect to the slot 15. Each vertical opening 22 extends from the bottom of each hollow pillar 16 upward to a point which is a matter of design preference, as long as the upper end of the opening 22 is high enough to avoid interference with the handle of another carrier whenever two such carriers are nested, as shown in FIG. 6. In the preferred embodiment which is shown in FIG. 1, the vertical opening 22 extends all the way to the top of each pillar 16. Each vertical opening 22 has a width which is substantially the same as that of the central slot 15 in the base such that the vertical openings are contiguous with the slot and form an effective extension thereof in a veritcal direction.

At each end of the slot 15 is an opening 24 in the base 12 which lies immediately under each of the tubular members 16, with each opening 24 having a shape which is substantially the same as the interior of the hollow pillar immediately above it. Thus, when the lower region 18 of a given pillar is cylindrical, the opening 24 will be circular; and the combination of a slot 15 and two spaced openings 24 will provide what may be described as a "dumbbell" shape. Furthermore, it is preferred that the base opening 24 be of a size which is identical to the interior size of a tubular post 16 at its juncture with the base. When this is so, there is no lip or ledge of base material which lies below a hollow pillar 16, and injection molding of the carrier is facilitated. A handle 26 is preferably molded so as to be an integral part of the carrier 10. As shown, the handle extends horizontally across the carrier and joins the tops of the two hollow pillars 16.

Figure 7:
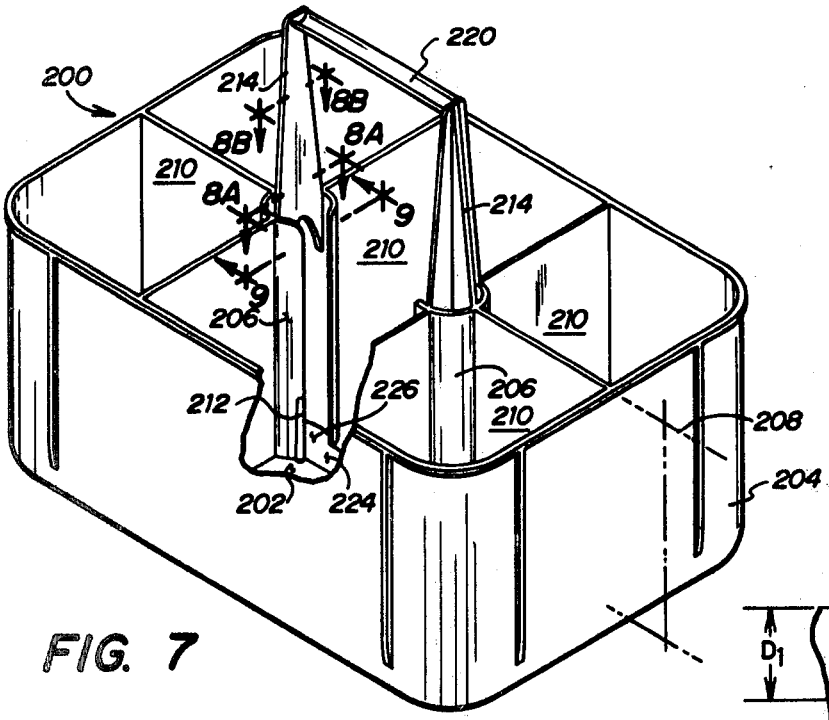
FIG. 7 is a perspective view of another embodiment of the bottle carrier wherein a tubular column extends only part of the way from the base toward each end of the handle.

Referring next to FIG. 7, another embodiment of the invention is disclosed in which the hollow pillars do not extend all the way to the handle region. In carrier 200, a rectangular base 202 is sized like the earlier-described bases, i.e., of essentially minimum dimensions for supporting six bottles of uniform size vertically. With such a size, the carton 200 may be readily substituted for cardboard carriers, and no adjustments of the bottle-handling machinery on an assembly line would be necessary. Thus, like the previous embodiment, a generally flat base is adapted for supporting six large bottles in two rows of three bottles each. And, the rectangular base 202 is about 7⅝ inches by 11 5/16 inches for quart-size bottles.

An upstanding wall 204 is integrally molded with the base 202 at the perimeter of said base, so that the flat base has a substantial bit of stiffness by virtue of its connection to a perpendicular wall around its periphery. Of course, a few draining holes may be provided in either the base or the sidewall 204 without significantly affecting the overall strength. The upstanding wall 204 preferably has a height of about five inches, so as to readily support bottles which are sized to contain about a quart of some beverage or other liquid. Thus, the height of the wall 204 is about the same as that of conventional cardboard carriers for quart or liter-size bottles.

A pair of hollow pillars 206 are also integrally molded with and extend upwardly from the base 202. The pillars 206 are positioned so that they are divided by a longitudinal plane 208 which extends centrally of the carrier between the two rows of bottles. Additionally, each of the pillars 206 lies in one of the transverse planes which extends between adjacent pairs of the bottles in a given row. Thus, the two cylindrical pillars 206 are positioned within a spatial envelope which is essentially a minimum envelope for containing six bottles. The diameter of each hollow pillar is about 1½ inch, such that the presence of the pillars in the center of a group of four bottles does not require any additional space for those bottles. The height of each of the two pillars is substantially the same as that of the peripheral wall 204, so that the pillars also have a side support function with regard to the bottles—preventing them from falling sideways or contacting an adjacent bottle. To further insure that there will be no bottle-to-bottle contact between any pair of adjacent bottles, a plurality of web members 210 may be provided so that they extend between respective ones of the hollow pillars and the peripheral wall 204. There is no web or other wall which extends longitudinally between the two pillars 206; and, such a connecting wall between the two pillars 206 is deliberately omitted, in order to foster the molding of an integral handle. If any additional insurance is desired against the possibility of bottle-to-bottle contact between the two central bottles, such insurance may be obtained by providing pairs of vertical ridges or ribs 212 at appropriate locations on the periphery of the pillars 206. The pairs of ribs 212 face each other, and extend into the low region between the two central bottles for a distance which is sufficient to maintain the central bottles errect. Thus, a total of four ridges 212, with two being located about 90 degrees apart on each of the two pillars 206, provide ample assurance that one bottle will not rub against another, even if the carrier 200 is vigorously vibrated on a moving truck or the like.

Figure 8A:
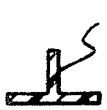
FIGS. 8A and 8B are cross-sectional view of the T-shaped structural members shown in FIG. 7.
Figure 8B:
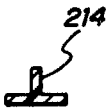
Figure 9:
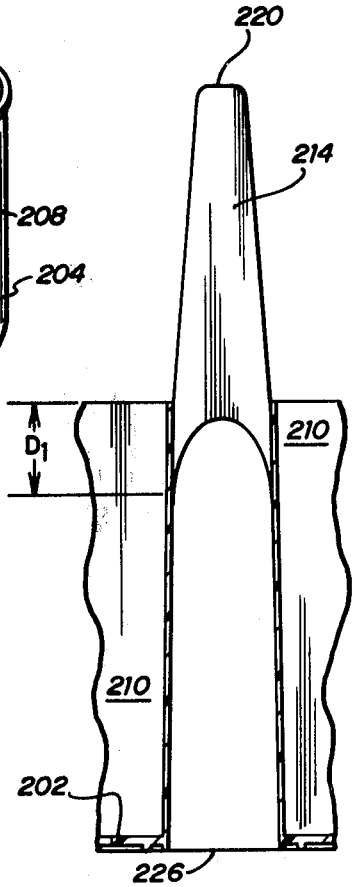
FIG. 9 is a transverse cross-sectional view of the handle-supporting structure, taken in the plane represented by lines 9—9 in FIG. 7.

A pair of structural supports 214 are integrally molded with said hollow pillars 206, and they extend upwardly above the hollow pillars for a length which is sufficient to provide ample clearance for a person's fingers to grasp a handle. This elevated distance for the supports 214 will usually be at least three inches, when the handle extends horizontally between the extreme upper ends of the structural support. A relatively great stiffness is built into the structural members 214 by virtue of providing them with a T-shaped cross section, as shown in FIGS. 8A and 8B. As will be evident from a comparison of FIGS. 8A and 8B, the structural members 214 taper upwardly, with their respective bases fitting within a circle having a diameter of about 1⅜ inches at their juncture with the hollow pillars, and fitting within a circle whose diameter is about ¾ inch in the vicinity of the handle. Since all of the weight which is supported by a carrier 200 is transferred to the handle through these structural members 214, there must be sufficient material between the members and the hollow pillars 206 to efficiently transmit such loads. This is accomplished by providing an overlap represented by the dimension $D_1$ shown in FIG. 9. While it is necessary that there be a coextensive region between the hollow pillars 206 and the structural member 214, that region does not have to be entirely T-shaped—because the stiffness of the cylindrical pillar is more than adequate in this region. Hence, the structure members 214 may be tapered from a position coincident with (or near) the top of a pillar 206 down into said pillar for a distance which is sufficient to provide the requisite load-transfer properties.

It is also preferable that the two T-shaped structural members be oriented such that the top parts of the T's are parallel to each other, and, the base parts (or legs) of the T's are preferably co-planar and extend in opposite directions. Hence, the two "legs" of the T-shaped members 214 lie in a central and longitudinal plane, while the "tops" of the T-shaped cross sections lie, respectively, in transverse and parallel planes.

A handle 220 is preferably molded so as to be an integral part of the carrier 200; it is generally horizontal and extends between the upper ends of the two structural members 214. Of course, the advantages of having an integrally formed handle can always be disregarded, and a separate handle could be appended to the carrier 200 at a later stage in manufacturing. While a separate handle is possible, it is certainly less desirable; and it is believed that most persons will opt to take advantage of all of the economics and beneficial features of straight-pull molding described herein. As with the previous described embodiment, the handle 220 is preferably concave as examined in a transverse direction; and, the open part of the concave handle preferably faces upwardly. Thus, the closed portion of the handle is oriented downwardly, so that a rounded gripping surface is provided for the comfort of a person who lifts a carrier full of heavy bottles. A comfortable width for the handle is about ½ inch; and the curvature of the handle is preferably such that an angle of about 180 degrees is encompassed by the curved handle.

In order to permit stacking of empty carriers, as well as permitting the carrier 200 to be manufactured with a straight pull in an injection molding machine, a slot 224 is provided in base 202, with the slot being centrally positioned along a longitudinal dividing plane 208 and extending from one pillar 206 to the other. As seen in FIG. 7, the slot 224 lies immediately below the handle 220. Additionally, a pair of round apertures 226 are provided in the base 202 immediately below the hollow pillars 206, where they merge with the slot 224.

In addition to the several parameters that were initially discussed in this disclosure, one further parameter is the compatibility of a bottle carrier with any special bottle-handling equipment that may be in use in a bottling plant. For example, it is well known to utilize automated equipment for grabbing six empty bottles and removing them from a carrier that has been returned to a bottling plant. It is also well known to simultaneously deposit six full bottles in an empty carrier on a production line. Of course, full bottles are heavier than empty ones, and more control must usually be exercised over the positioning and movement of a full bottle. One way in which full bottles are suitably deposited in the respective bottle-receptor areas in a carrier is to use elongated fingers that temporarily extend down into a respective receptor area and insure that a bottle will slide gently into place.

Figure 10:
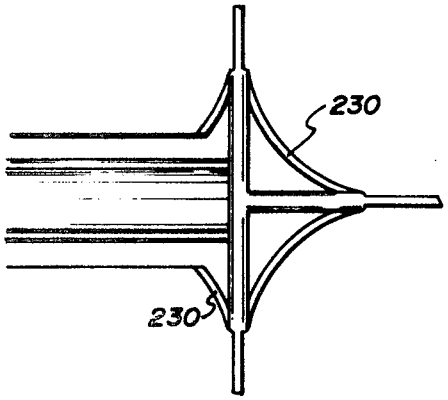
FIG. 10 is a top plan view of another embodiment of a tubular column, wherein four concave sections replace the four convex sections that are shown in FIG. 7, with only fragmentary portions of the adjacent elements being shown.

With certain bottle-handling equipment which relies upon elongated guides or "fingers" for controlling the deposit of bottles, the side clearance between the bottle and an adjacent sidewall or web may be very small. In such circumstances, it may be advantageous to reverse the orientation of the arcs which together make up the tubular column which supports the handle structure. In the embodiment shown in FIG. 10, each of the four arcs 230 are turned so that the tubular column appears as four concave sections instead of four convex sections when viewed from the top. These wall segments 230 are topped, of course, by a T-shaped structural member which supports one end of a handle. The overall rigidity of this particular embodiment is somewhat less than the embodiment where the segments are convex; but the decrease in stiffness, etc., is not sufficient to create an unacceptable design. And, the overall strength of the embodiment shown in FIG. 10 is still appreciably stronger than the stiffness of a flat plate, as exemplified by the construction in U.S. Pat. No. 4,040,517. As before, the construction of FIG. 10 is adaptable for molding with a single, straight pull; and, no moving cams, sliding inserts and the like are required, because all portions of the handle structure, etc., are open to the bottom of the mold—so that solid cores may be employed in injection molding.

Figure 11:
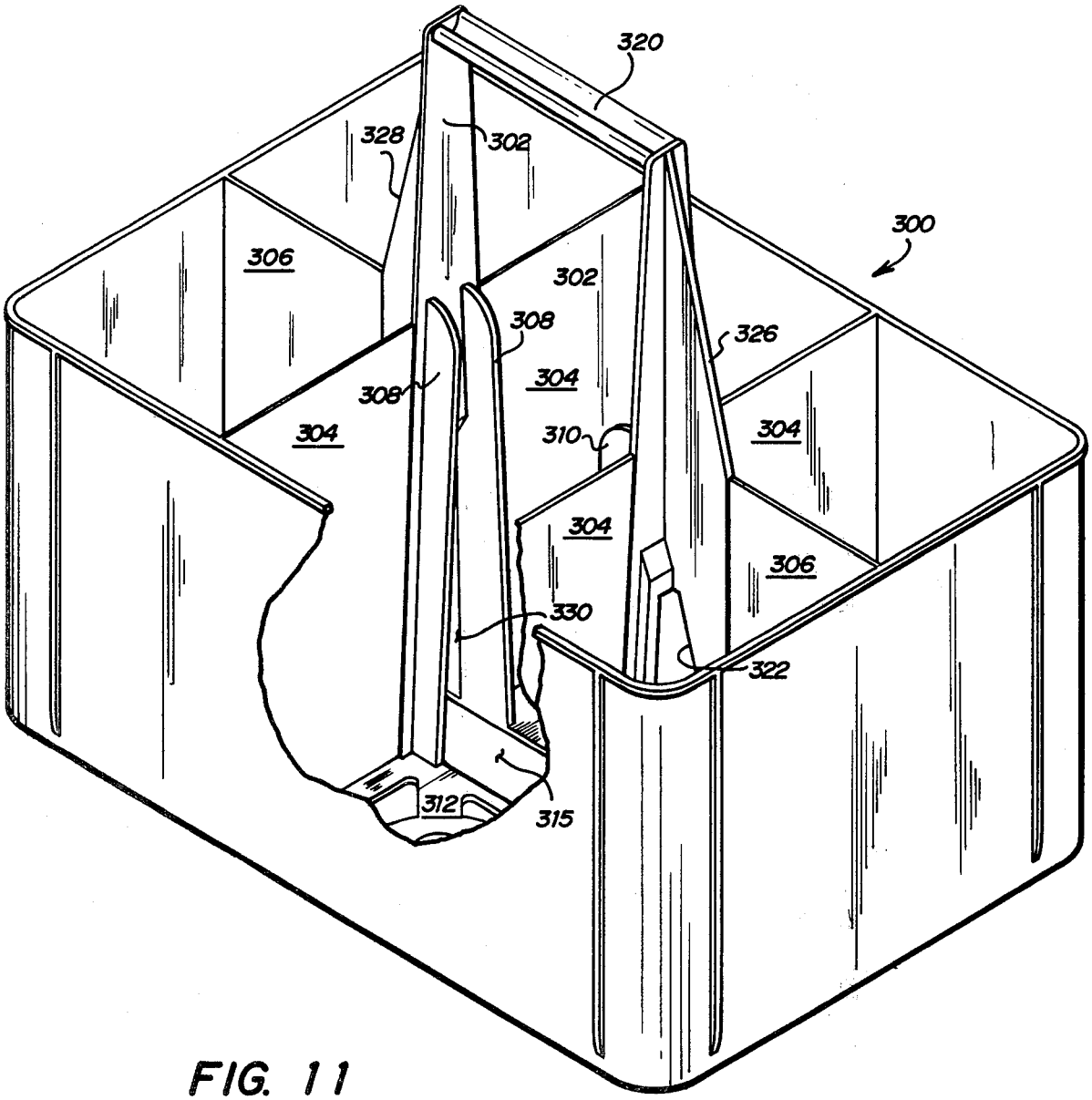
FIG. 11 is a perspective view of another embodiment of a bottle carrier wherein the handle is connected directly to the base with two T-shaped structural members.

Referring next to FIG. 11, still another embodiment of the invention 300 is disclosed in which a pair of structural supports for the handle are provided with a T-shaped cross section in the region above the bottle pockets. Unlike the embodiments of FIGS. 1 and 7, however, the lower part of the handle supports do not protrude significantly into the bottle pockets. Such an embodiment 300 is particularly useful when automatic bottle-handling equipment is utilized that has elongated fingers which extend down into the bottle pockets for the purpose of guiding a falling bottle—so as to insure that the bottle accurately enters the pocket. In other words, the lower part of the handle supports 302 merge rather smoothly with the webs 304, 306 which define the four end pockets of a six-bottle carrier.

In contrast to the bottle carrier shown in U.S. Pat. No. 4,040,517 to Torokvei, with the carrier 300 there is no central dividing wall between two parallel rows of three bottles. Hence, it is advantageous to provide some kind of structure which will serve to preclude the two central bottles (which rest immediately next to and on either side of the handle) from contacting one another. This is preferably accomplished with two pairs of spaced-apart and generally parallel rails 308, 310 which extend upward from the carrier floor 312 to a location adjacent the plane which generally defines the top of the bottle pockets. These pairs of rails 308, 310, with one pair extending inwardly from each of the two handle supports 302, have a width which is sufficient to prevent transverse movement of a bottle in one pocket toward a bottle in the adjacent pocket. Typically, this width (in a direction parallel to the longitudinal axis of the carrier) is about ½ inch, although it need not be uniform from the bottom to the top. In order that the advantage of a stright-pull may be obtained during manufacture, however, any taper in the width of the ribs should be of such a nature that there is no undercut segment which would require use of a movable can or the like. Also, to insure that the straight-pull manufacture properties are available, the spacing between a pair of rails (in a transverse direction) must be at least as wide as the width of the handle which lies above the rails. Hence, if the handle is about ½ inch in width, then the minimum distance between a pair of rails will typically be on the order of ¾ inch.

The thickness of each of the rails could reasonably be a fairly modest amount if a designer is interested only in separating the two central bottles. However, if the thickness is increased to, say, 0.075 inch, then a substantial degree of rigidity is imparted to the carrier 300, in the same manner as provided by the tubular members 16 shown in FIG. 1. For this reason, then, it is advantageous to make the average thickness of the rails about 0.075 inch. The rails are usually somewhat thinner at the top than at the bottom, to foster removal of the carrier 300 from the mold. As for their length, the rails 308, 310 need not extend much above the tops of the bottle pockets, because most side-to-side contact between adjacent bottles occurs—if at all—in the lower part of a bottle carrier. And, the longitudinal web 306 which extends radially outward from the transverse pieces provides more than an ample foundation for the handle supports. Hence, very little would be gained by extending the rails 308, 310 as high as the handle 320, and at least some finger space would be lost if the rails were to extend that high. Whenever the breadth dimension of a handle support 302 (measured in a longitudinal direction) is at least 50% as wide as the width dimension (measured in a transverse direction), then the handle supports will have a substantial amount of inertia about any axis which is parallel to the base 312. So, the extra stiffness that would be provided by very high rails 308, 310 is really not necessary. Too, extending the rails unusually high on the vertical pieces would increase the amount of plastic which is utilized in the carrier 300 without any concomitant benefit. It is appropriate, therefore, to terminate the rails 308, 310 in the vicinity of the bottle pockets. A relatively smooth arc is preferably provided on the tops of the rails 308, 310, in order to make them cosmetically appealing and to preclude any accidental injury to a person's fingers that might result from contact with a sharp corner, etc.

As with the other embodiments shown herein, there is an opening 315 in the floor 312 of the carrier, and similar openings in the dividing webs and supports, in order that the handle of one empty carrier 300 may be inserted (or nested) into the bottom of another carrier. In both longitudinal and transverse directions, then, appropriate recesses are provided in the lower portions of the carriers 300; and they are shaped similarly to—and sized just slightly larger than—the super-structure of a carrier. Any number of similarly oriented empty carriers may therefore be nested together in such a way that the floor of a first carrier rests immediately on top of the bottle pockets of a second carrier.

Figure 12:
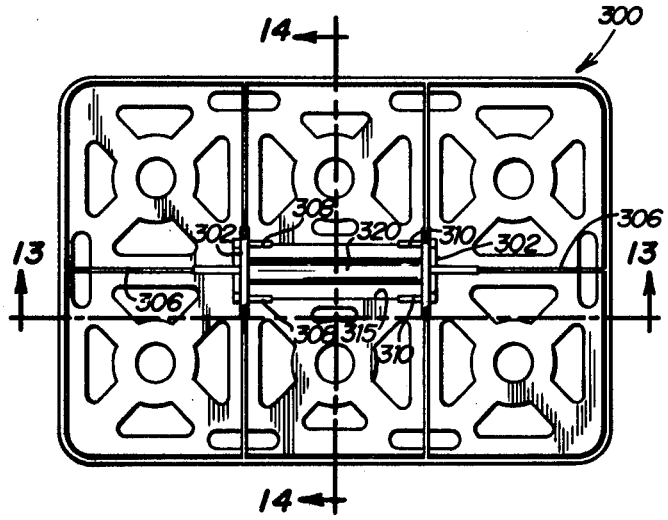
FIG. 12 is a top, plan view of the carrier shown in FIG. 11.

In FIG. 12, which is a top view of the carrier 300, it will be readily apparent that the non-planar handle supports 302 do not protrude into the space which is to be occupied by a bottle. Furthermore, the corners of each bottle pocket are sufficiently full (or "square") as to offer ample room for bottle-loading fingers to extend a short distance into the pockets in order to better control the loading of full bottles of beverage or the like.

Figure 13:
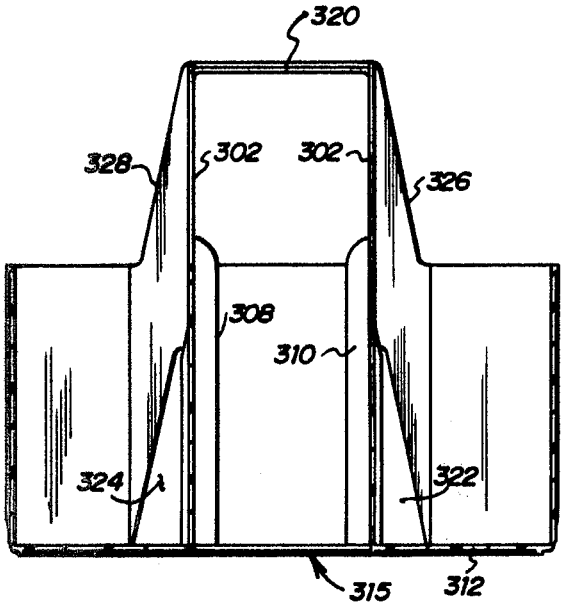
FIG. 13 is a cross-sectional, elevational view of the carrier shown in FIG. 12, taken in the plane represented by lines 13—13.
Figure 14:
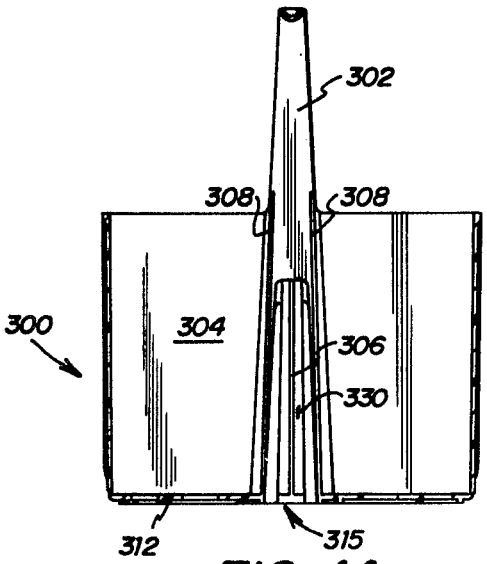
FIG. 14 is a transverse, cross-sectional and elevational view of the carrier shown in FIG. 11.

In the cross-sectional, longitudinal view of the carrier shown in FIG. 13, it will be apparent that the lower part of each handle support 302 is offset (outwardly) with respect to the upper portion. This slight offset provides ample clearance for the handle 320 of an empty carrier to be inserted through the bottom opening 315 of another carrier. Also, the oppositely facing recesses 322, 324 in the longitudinal webs 306 provide ample clearance for the gusset plates 326, 328 of the T-shaped handle supports 302. While the reinforcing plates 326, 328 are shown as extending all the way to the top of the handle supports 302 in this preferred embodiment of the invention, it should be possible to shorten the plates somewhat without affecting the overall strength too much. If the gusset plates 326, 328 are made to be somewhat lower than full height, the longitudinal recesses 322, 324 could be correspondingly reduced, of course. In addition to the longitudinal recesses 322, 324, there are two transverse recesses 330 in the respective bottom portions of the handle supports. One of these recesses 330 is clearly shown in FIG. 14. Also readily apparent in this view is the fact that the generally vertical ribs 308 are inclined slightly toward each other. Perhaps not so apparent from the figures, however, is the fact that the thickness of the ribs 308, 310 is preferably tapered from the bottom to the top, as is the thickness of the handle supports 302.

Figure 4:
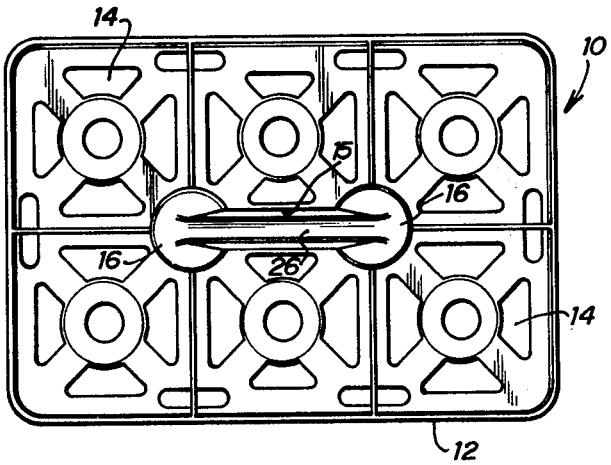
FIG. 4 is a top, plan view of the carrier shown in FIG. 1.
Figure 5:
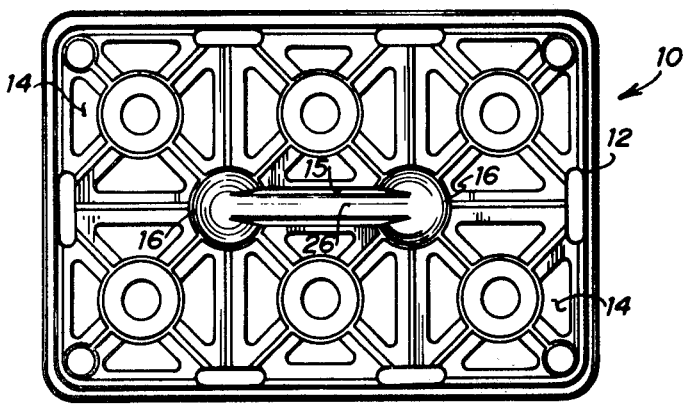
FIG. 5 is a bottom plan view of the carrier shown in FIG. 1.

One of the rather significant advantages of the constructions disclosed herein is their resistance to lateral (usually horizontal) loading. This is important because most failures of a bottle carton are believed to be the result of structural failures associated with either the handle itself or its supporting structure. And, vertical loading of a carrier, which routinely arises from grasping the handle and lifting a carrier, is reasonably easy to deal with—by simple steps such as making handle supports thick and using material which is strong in tension. However, there are also occasions when an unusual side load can be applied to a carrier—if it is used for something other than carrying bottles. For example, if a person uses an empty carrier as a stool, a brace or a prop, it is conceivable that very damaging lateral loads could be imposed on the handle supports. Hence, the resistance to bending and buckling stresses can have a significant impact on the long-term durability of a carrier. A structural analysis of the carrier shown in FIG. 1 has been accomplished, and it has shown that the tubular handle support is approximately 15 times more resistant to side-load bending and buckling than a flat plate configuration such as exemplified by FIG. 4 of U.S. Pat. No. 4,040,517. The substitution of another cross-sectional shape (such as a square or a triangle) for the cylindrical shape depicted in the handle supports of FIG. 1 would no doubt create some reduction in bending resistance; but even a triangular handle support would be greatly superior to one of the commercial available flat plate supports. Flexural stiffness (i.e., resistance to bending deflection) is proportional to area moment of inertia; so, a thin wall cylindrical tube will naturally have the optimum stiffness, and a square tube will have very similar properties. Overall, the strength-to-weight ratio of the carrier 10 has been calculated to be superior to that of at least one commercially available bottle carrier by a factor greater than 10. It should be appreciated, therefore, that there are substantial advantages and benefits which flow from the constructions described herein.

While only a few embodiments of the invention (including the preferred embodiment) have been both described and illustrated in great detail herein, it should be understood by those skilled in the art that certain changes and modifications may be resorted to without departing from the spirit and scope of the invention—as described in the claims appended hereto.

What is claimed is:

1. A carrier for a plurality of bottles and the like, comprising:

(a) a generally planar base having a longitudinal slot therein, and the base being adapted to receive and support a plurality of bottles, and the base being sufficiently small so that the carrier may be substituted for equivalent cardboard bottle carriers;

(b) a pair of hollow pillars extending upwardly from the base, with one pillar being adjacent each end of the slot, and the pillars being slightly tapered from their bottoms to their tops, and said pillars each having a relatively long vertical opening on that side which faces the other pillar, with said vertical openings being contiguous with the slot in the base; and (c) a handle extending between the tops of the two pillars, with the length of the handle being slightly less than the length of the slot, and the width of the handle being slightly less than the width of the slot, whereby the handle of an empty carrier may be received through the slot of another carrier for fostering the stacking of said carriers with a minimal amount of consumed space.

2. The bottle carrier as claimed in claim 1 wherein the hollow pillars are generally cylindrical.

3. The bottle carrier as claimed in claim 2 wherein the base is sufficiently large to support six large bottles of at least 32 liquid ounces each, and wherein the diameter of the cylindrical pillars is in excess of one inch, and the wall thickness of the pillars is at least 0.060 inch, such that the moment of inertia of the pillars is relatively large and the resistance of the carrier to lateral loading is very high.

4. The bottle carrier as claimed in claim 1 wherein the base, the hollow pillars and the handle are integrally molded, and the vertical openings in the hollow pillars extend from the base to the locations where the handle connects with the hollow pillars.

5. A plastic bottle carrier for six beverage bottles, with the six bottles being arranged in two rows of three bottles each, comprising:

(a) a rectangular base having a receptor area for supporting each of the six bottles, with the six receptor areas being arranged in two longitudinal rows of three areas each, and the rows being parallel and adjacent each other;

(b) a longitudinal plane extending vertically between the two rows of receptor areas and centered therebetween;

(c) a pair of transverse planes extending perpendicularly to said longitudinal plane, with one transverse plane being positioned between a first grouping of four of the six bottles, and the other transverse plane being positioned between a different grouping of four bottles;

(d) a pair of hollow pillars fixed to and extending upwardly from the base, with one pillar being positioned at each of the intersections of the longitudinal plane with the two transverse planes; and (e) a handle extending between the two pillars in a direction generally parallel to the base.

6. The bottle carrier as claimed in claim 5 wherein at least the major portions of the two hollow pillars are cylindrical, whereby the moment of inertia of the two pillars is optimized.

7. The bottle carrier as claimed in claim 5 wherein there is an elongated opening in the base between the two pillars, and the handle is sized so that the handle of a first empty carrier may be inserted into the base opening of a second carrier, so as to conserve space in storing a plurality of empty containers, all of which are oriented upright.

8. The bottle carrier as claimed in claim 5 and further including a peripheral wall around the base and extending upwardly therefrom for fostering the safe carrying of bottles on the base, and the peripheral wall being molded as an integral part of a plastic bottle carrier.

9. A molded plastic bottle carrier, comprising:

(a) a generally horizontal base upon which a plurality of bottles may be erectly positioned, and the base having a width which is only very slightly greater than the total width of two bottles which the carrier is designed to carry;

(b) a pair of spaced and generally tubular posts which are affixed to and extend vertically above the base;

(c) a handle extending between the two tubular posts near the tops thereof; and (d) means for maintaining the bottles erect on the base if the base is tilted.

10. The bottle carrier as claimed in claim 9 wherein the means for maintaining the bottles erect on the base includes a pair of spaced sidewalls, with the distance between said sidewalls being essentially the same as the combined diameters of two of the bottles which the carrier is sized to carry, and there being a substantial overlap in a width direction between two side-by-side bottles and a tubular post, such that the distance between two sidewalls is significantly less than the combination of said two bottles and the width of a tubular post.

11. The carrier as claimed in claim 10 wherein said tubular posts are generally cylindrical near their juncture with the base.

12. The bottle carrier as claimed in claim 10 wherein the outer diameter of the two generally cylindrical posts is about 1½ inches at their juncture with the base.

13. The bottle carrier as claimed in claim 9 wherein the tubular posts are slightly tapered toward their tops.

14. The bottle carrier claimed in claim 9 wherein the handle is integrally formed with the two tubular posts.

15. The bottle carrier as claimed in claim 9 and further including a longitudinal opening in the base which extends under and between the pair of tubular posts, and said opening being sufficiently long and wide to receive the handle of another bottle carrier, and there being a slot in both of the confronting walls of the two tubular posts adjacent their bases, so that the handle of a second carrier may pass through the base opening and up into the space between the two posts of a first carrier, whereby a plurality of empty bottle carriers may be stacked in a relatively small space.

16. The bottle carrier as claimed in claim 9 wherein the two tubular posts are so positioned and have a transverse cross-section which is sufficient to inhibit contact between the bases of any two adjacent bottles when the bottles are arranged in two rows of three bottles each.

17. A one-piece, integrally molded plastic carton which is adapted for carrying six beverage bottles, and which is sized so that it may replace a cardboard carton, comprising:

(a) a base having a generally rectangular shape of essentially minimum dimensions for supporting six vertical bottles of uniform size in two parallel rows of three bottles each, and said base having a central aperture through which the handle of a second empty carton may be inserted when it is desired to stack a plurality of empty cartons in order to consume a minimum amount of space;

(b) a handle adapted to be gripped for carrying the carton, and said handle being generally horizontal and extending longitudinally of the carton above the base; and (c) a pair of non-planar supports for said handle, with each support being integrally molded to both the base and the handle, with the breadth dimension of said supports being at least 50% as wide as the width dimension of said supports, with the breadth being measured in a direction perpendicular to the width and both being measured in a plane parallel to the base, whereby the handle supports have a substantial moment of inertia about any axis which is parallel to the base of the carton.

18. The plastic carton as claimed in claim 17 wherein the non-planar supports are thin wall tubular members.

19. A carrier adapted for carrying six beverage bottles, comprising:

(a) a base having a generally rectangular shape and being generally flat for vertically supporting six bottles in two parallel rows of three bottles each;

(b) an upstanding wall integrally molded with the base at the periphery of said base, and said upstanding wall having a height of several inches so as to readily support bottles as large as those which contain as much as one liter of liquid;

(c) a pair of hollow pillars integrally molded with and extending upwardly from the base, with said pair of pillars being on a longitudinal plane which extends centrally of the carrier between the two rows of bottles, and each of the pillars lying respectively in a transverse plane which extends between adjacent pairs of the bottles in a given row, and the height of said hollow pillars being substantially the same as the height of the peripheral upstanding wall;

(d) a plurality of web members extending between respective ones of the hollow pillars and the peripheral wall;

(e) a pair of structural members integrally molded with said hollow pillars and extending upwardly above said hollow pillars for a length of at least three inches, with each of said structural members having a T-shaped cross section with the top part of each T being parallel to each other and the base part of each T being co-planar and extending in opposite directions; and (f) a handle integrally molded to the upper ends of each of the two structural members, and said handle having a generally concave cross section as measured in a transverse direction, with the open part of the concave handle facing upwardly, whereby the closed portion of the handle is oriented downwardly such that a rounded gripping surface is provided for a person who lifts the carrier.

20. The bottle carrier as claimed in claim 19 and further including a central slot in the base, with said slot being divided by a longitudinal plane which passes centrally through the carrier, and there also being a pair of apertures in said base which lie under the pair of hollow pillars, and there also being a vertical slot in each of the confronting walls of the two hollow pillars, with said slots having a width approximately the same as the width of the base slot, and said pillar slots extending for the full length of each pillar, such that the apertures below the hollow pillars are in full communication with the base slot, whereby a core member of an injection mold may extend upwardly through the slots in the base and the hollow pillars to form the bottom of the handle during the molding process.

21. The bottle carrier as claimed in claim 19 wherein the plurality of web members and the peripheral wall form bottle pockets for individually accommodating the six bottles, and the hollow pillars extend at least partially into the six bottle pockets, and wherein those portions of the hollow pillars which extend into the two central pockets extend far enough so as to maintain the central bottles erect and prevent them from experiencing any significant sideward movement, whereby glass-to-glass contact between the two central bottles is precluded.

22. The bottle carrier as claimed in claim 21 wherein the hollow pillars are cylindrical and each has a diameter of about 1½ inch, and wherein the bottle pockets have a size that is sufficient to accommodate quart-size bottles.

23. A molded plastic carton adapted for carrying six bottles which are arranged in two parallel rows of three bottles each, comprising:

(a) a base having a generally rectangular shape with a longitudinal axis, and being relatively flat so that it may vertically support six bottles in two parallel rows of three bottles each;

(b) an upstanding wall integrally molded with the base at the periphery of said base, and including two end wall sections and two side wall sections;

(c) a pair of integrally molded handle supports which extend upwardly and terminate at locations which are slightly lower than the height of the bottles to be carried by said carton, and said handle supports being generally planar and oriented in two spaced and parallel planes which are perpendicular to the longitudinal axis of said base, with said handle supports being separated by a distance which is approximately the same as the diameter of a bottle to be carried in said carton;

(d) a set of web members associated with and extending radially outwardly from each of said handle supports and connecting a respective handle support with the peripheral wall of said carton, with said webs being effective to preclude the end bottles from contacting both each other and the two central bottles;

(e) a pair of gusset plates, each of which is integrally molded with one of said handle supports and each lying in the longitudinal plane of the carton, with said gusset plates forming vertical extensions of the respective webs which join the handle supports to the two end wall sections, and each of said gusset plates intersecting a handle support adjacent the center line thereof so as to form a T-shaped structure for supporting a handle;

(f) a pair of integrally molded ribs associated with each of the handle supports, and said pairs of ribs facing one another and extending into the low region between the two central bottles for a distance which is sufficient to maintain the central bottles in an upright mode, whereby one central bottle cannot lean toward and make physical contact with the other central bottle; and (g) a handle extending between the tops of the two handle supports.

24. The bottle carton as claimed in claim 23 wherein the integrally molded ribs associated with each of the handle supports are slightly inclined toward one another, with the top portions of said ribs being closer than the bottom portions thereof.

25. The bottle carton as claimed in claim 23 wherein the bottom portions of said handle supports are offset in a longitudinally outward direction with respect to the upper portions of said structural supports, whereby the nesting of a pair of bottle cartons is fostered by precluding any interference between adjacent portions of a pair of vertically nested handle supports.

26. The bottle carton as claimed in claim 23 wherein the handle is integrally molded with said handle supports, and the length of said handle is substantially the same as the diameter of the bottles which are adapted to be carried by said carton, and the handle having a transverse cross-section which is concave, and the concave surface of the handle faces upwardly, whereby a very heavy bottle carton may be carried without any appreciable discomfort to a person's hand.

* * * * *